US007296355B2

(12) United States Patent
Onion

(10) Patent No.: US 7,296,355 B2
(45) Date of Patent: Nov. 20, 2007

(54) ADJUSTABLE BLADE-ASSISTING MECHANISM FOR A FOLDING KNIFE

(75) Inventor: Kenneth J. Onion, Kaneohe, HI (US)

(73) Assignee: Kai U.S.A., Ltd., Tualatin, OR (US)

( * ) Notice: Subject to any disclaimer, the term of this patent is extended or adjusted under 35 U.S.C. 154(b) by 87 days.

(21) Appl. No.: 10/964,577

(22) Filed: Oct. 12, 2004

(65) Prior Publication Data

US 2005/0097754 A1 May 12, 2005

Related U.S. Application Data

(60) Provisional application No. 60/510,639, filed on Oct. 10, 2003.

(51) Int. Cl.
*B26B 1/04* (2006.01)

(52) U.S. Cl. ..... 30/159; 30/160; 30/161

(58) Field of Classification Search ..... 30/158, 30/159, 161, 160

See application file for complete search history.

(56) References Cited

U.S. PATENT DOCUMENTS

| | | | |
|---|---|---|---|
| 23,975 | A | 5/1859 | Belcher |
| 57,902 | A | 9/1866 | Hibbard |
| 226,910 | A | 4/1880 | Friebertshauser |
| 338,251 | A | 3/1886 | Crandall et al. |
| 382,967 | A | 5/1888 | Fullerton |
| 530,792 | A | 12/1894 | Nordlow |
| 551,052 | A | 12/1895 | Waldron et al. |
| 552,928 | A | 1/1896 | Russell |
| 557,760 | A | 4/1896 | Brauer |
| 577,593 | A | 2/1897 | Bronson et al. |
| 600,442 | A | 3/1898 | Nell |
| 616,689 | A | 12/1898 | Ruettgers |
| 749,230 | A | 1/1904 | Severance |
| 777,358 | A | 12/1904 | Weck |
| 825,976 | A | 7/1906 | Neiglick |
| 845,792 | A | 3/1907 | Jenkins |
| 969,909 | A | 9/1910 | Schrade et al. |
| 1,057,525 | A | 4/1913 | Bruecker |
| 1,189,005 | A | 6/1916 | Seely |
| 1,315,503 | A | 9/1919 | Hughes |
| 1,319,532 | A | 10/1919 | Rasmussen |
| 1,357,398 | A | 11/1920 | Haywood |
| 1,412,373 | A | 4/1922 | Shields |
| 1,417,872 | A | 5/1922 | Wall |
| 1,440,793 | A | 1/1923 | Rasmussen |

(Continued)

FOREIGN PATENT DOCUMENTS

| | | |
|---|---|---|
| DE | 29469 | 6/1884 |

(Continued)

*Primary Examiner*—Hwei-Siu C. Payer
(74) *Attorney, Agent, or Firm*—Seed IP Law Group PLLC

(57) ABSTRACT

A folding knife is disclosed. The folding knife includes a handle; a blade connected to the handle in a manner allowing movement of the blade between a closed position in which the blade extends along the handle and an open position in which the blade extends away from the handle; and a blade-assisting mechanism configured to apply a manually adjustable force to urge the blade towards the open position over at least a portion of the blade travel between the closed position and the open position.

25 Claims, 5 Drawing Sheets

U.S. PATENT DOCUMENTS

| | | | | |
|---|---|---|---|---|
| 1,454,665 | A | 5/1923 | Bobek | |
| 1,496,188 | A | 6/1924 | Wall | |
| 1,515,688 | A | 11/1924 | Love | |
| 1,584,165 | A | 5/1926 | Brown | |
| 1,603,914 | A | 10/1926 | Hermann | |
| 1,614,949 | A | 1/1927 | Finley | |
| 1,701,027 | A | 2/1929 | Brown | |
| 1,738,496 | A | 12/1929 | Laux | |
| 1,743,022 | A | 1/1930 | Carman | |
| 1,810,031 | A | 6/1931 | Schrade | |
| 1,864,011 | A | 6/1932 | Brown | |
| 2,284,168 | A | 5/1942 | Rickenbacher | 30/162 |
| 2,286,524 | A | 6/1942 | Wilbur | 30/161 |
| D137,408 | S | 3/1944 | Herrick | |
| 2,407,897 | A | 9/1946 | Newman | 30/159 |
| 2,455,765 | A | 12/1948 | Harvey | 248/360 |
| 2,736,959 | A | 3/1956 | Simon et al. | 30/123 |
| 3,079,784 | A | 3/1963 | Pavioski | 70/456 |
| 3,404,456 | A | 10/1968 | Chilko | 30/155 |
| 3,868,774 | A | 3/1975 | Miori | 30/161 |
| 4,040,181 | A | 8/1977 | Johnson | 30/161 |
| 4,133,106 | A | 1/1979 | Addis | 30/160 |
| 4,148,140 | A | 4/1979 | Lile | 30/161 |
| 4,173,068 | A | 11/1979 | Cargill | 30/161 |
| 4,211,003 | A | 7/1980 | Collins | 30/162 |
| 4,218,819 | A | 8/1980 | Phelps | 30/157 |
| 4,240,201 | A | 12/1980 | Sawby et al. | 30/161 |
| 4,268,960 | A | 5/1981 | Reinschreiber | 30/161 |
| 4,274,200 | A | 6/1981 | Coder | 30/161 |
| 4,322,885 | A | 4/1982 | Osada | 30/162 |
| 4,347,665 | A | 9/1982 | Glesser | 30/161 |
| 4,356,631 | A | 11/1982 | Guth | 30/154 |
| 4,389,775 | A | 6/1983 | Collins | 30/156 |
| 4,404,748 | A | 9/1983 | Wiethoff | 30/161 |
| 4,426,779 | A | 1/1984 | Morgan | 30/138 |
| 4,439,922 | A | 4/1984 | Sassano | 30/161 |
| 4,442,600 | A | 4/1984 | Felix-Dalichow | 30/161 |
| 4,451,982 | A | 6/1984 | Collins | 30/161 |
| 4,466,561 | A | 8/1984 | Slaughter | 224/163 |
| 4,481,712 | A | 11/1984 | Phelps | 30/151 |
| 4,494,309 | A | 1/1985 | Gray | 30/151 |
| 4,494,310 | A | 1/1985 | Slaughter | 30/155 |
| 4,502,221 | A | 3/1985 | Pittman | 30/160 |
| 4,525,928 | A | 7/1985 | Foster | 30/158 |
| 4,529,111 | A | 7/1985 | Hayakawa | 224/163 |
| 4,541,175 | A | 9/1985 | Boyd et al. | 30/161 |
| 4,541,556 | A | 9/1985 | Collins et al. | 224/196 |
| 4,561,577 | A | 12/1985 | Moore | 224/232 |
| 4,570,341 | A | 2/1986 | Konneker | 30/161 |
| 4,600,133 | A | 7/1986 | Maihos | 224/232 |
| 4,604,803 | A | 8/1986 | Sawby | 30/161 |
| 4,612,706 | A | 9/1986 | Yunes | 30/160 |
| 4,670,984 | A | 6/1987 | Rickard | 30/161 |
| 4,719,700 | A | 1/1988 | Taylor, Jr. | 30/158 |
| 4,741,106 | A | 5/1988 | Yamagishi | 30/161 |
| 4,776,094 | A | 10/1988 | Glesser | 30/160 |
| 4,802,279 | A | 2/1989 | Rowe | 30/155 |
| 4,805,303 | A | 2/1989 | Gibbs | 30/161 |
| 4,805,819 | A | 2/1989 | Collins | 224/232 |
| 4,811,486 | A | 3/1989 | Cunningham | 30/161 |
| 4,837,932 | A | 6/1989 | Elsener | 30/161 |
| 4,848,000 | A | 7/1989 | O'Dell | 30/158 |
| 4,893,409 | A | 1/1990 | Poehlmann | 30/161 |
| 4,896,424 | A | 1/1990 | Walker | 30/349 |
| 4,909,424 | A | 3/1990 | Reynolds | 224/232 |
| 4,947,552 | A | 8/1990 | Barnes | 30/161 |
| 4,974,323 | A | 12/1990 | Cassady | 30/155 |
| 4,979,301 | A | 12/1990 | Walker | 30/161 |
| 5,044,079 | A | 9/1991 | Gibbs | 30/160 |
| 5,060,379 | A | 10/1991 | Neely | 30/161 |
| 5,092,045 | A | 3/1992 | Boyd, Jr. et al. | 30/161 |
| 5,095,624 | A | 3/1992 | Ennis | 30/161 |
| 5,111,581 | A | 5/1992 | Collins | 30/161 |
| 5,123,167 | A | 6/1992 | Kelley | 30/151 |
| 5,131,149 | A | 7/1992 | Thompson et al. | 30/161 |
| D333,251 | S | 2/1993 | Glesser | D8/99 |
| D336,602 | S | 6/1993 | Thompson et al. | D8/99 |
| 5,217,150 | A | 6/1993 | Chen | 224/163 |
| 5,217,151 | A | 6/1993 | Parsons | 224/253 |
| D345,289 | S | 3/1994 | Sakai | D8/99 |
| 5,293,690 | A | 3/1994 | Cassady | 30/161 |
| D348,599 | S | 7/1994 | Sakai | D8/99 |
| 5,325,588 | A | 7/1994 | Rogers | 30/161 |
| 5,331,741 | A | 7/1994 | Taylor, Jr. | 30/158 |
| 5,349,753 | A | 9/1994 | Gaffney | 30/155 |
| 5,361,497 | A | 11/1994 | Crawford | 30/155 |
| 5,400,509 | A | 3/1995 | Collins | 30/161 |
| 5,425,175 | A | 6/1995 | Rogers | 30/161 |
| 5,437,101 | A | 8/1995 | Collins | 30/153 |
| 5,450,670 | A | 9/1995 | Sakai | 30/298.4 |
| 5,461,786 | A | 10/1995 | Miller | 30/161 |
| D366,408 | S | 1/1996 | Sessions et al. | D8/99 |
| 5,493,781 | A | 2/1996 | Saito | 30/162 |
| 5,502,895 | A | 4/1996 | Lemaire | 30/158 |
| 5,511,310 | A | 4/1996 | Sessions et al. | 30/161 |
| 5,511,311 | A | 4/1996 | Collins | 30/162 |
| 5,515,610 | A | 5/1996 | Levin et al. | 30/161 |
| 5,537,750 | A | 7/1996 | Seber et al. | 30/161 |
| 5,546,662 | A | 8/1996 | Seber et al. | 30/161 |
| D373,716 | S | 9/1996 | Keys et al. | D8/107 |
| 5,581,895 | A | 12/1996 | Jeffcoat | 30/294 |
| 5,596,808 | A | 1/1997 | Lake et al. | 30/161 |
| 5,615,484 | A | 4/1997 | Pittman | 30/161 |
| 5,647,129 | A | 7/1997 | Stamper | 30/139 |
| D385,173 | S | 10/1997 | McWillis | D8/99 |
| 5,685,079 | A | 11/1997 | Brothers et al. | 30/161 |
| 5,689,885 | A | 11/1997 | Walston | 30/160 |
| 5,692,304 | A | 12/1997 | Campbell | 30/161 |
| 5,699,615 | A | 12/1997 | Chen | 30/160 |
| D392,538 | S | 3/1998 | Buck et al. | D8/99 |
| D392,539 | S | 3/1998 | Balolia | D8/99 |
| 5,737,841 | A | 4/1998 | McHenry et al. | 30/161 |
| 5,755,035 | A | 5/1998 | Weatherly | 30/161 |
| 5,781,998 | A | 7/1998 | Stamper | 30/139 |
| 5,802,722 | A | 9/1998 | Maxey et al. | 30/160 |
| D399,113 | S | 10/1998 | Balolia | D8/99 |
| 5,815,927 | A | 10/1998 | Collins | 30/161 |
| 5,819,414 | A | 10/1998 | Marifone | 30/160 |
| 5,822,866 | A | 10/1998 | Pardue | 30/161 |
| 5,822,867 | A | 10/1998 | Sakai | 30/298.4 |
| 5,826,340 | A | 10/1998 | Hull | 30/161 |
| 5,839,194 | A | 11/1998 | Bezold | 30/161 |
| 5,845,404 | A | 12/1998 | Jeffcoat | 30/125 |
| D407,003 | S | 3/1999 | Macowski et al. | D8/99 |
| 5,875,552 | A | 3/1999 | Chen | 30/161 |
| 5,878,500 | A | 3/1999 | Emerson | 30/158 |
| 5,887,347 | A | 3/1999 | Gibbs | 30/161 |
| 5,964,036 | A | 10/1999 | Centofante | 30/161 |
| 5,966,816 | A | 10/1999 | Roberson | 30/156 |
| D422,479 | S | 4/2000 | Pardue | D8/99 |
| 6,079,106 | A | 6/2000 | Vallotton | 30/161 |
| 6,122,829 | A | 9/2000 | McHenry et al. | 30/161 |
| 6,125,543 | A | 10/2000 | Jhones | 30/161 |
| 6,145,202 | A | 11/2000 | Onion | 30/160 |
| D434,631 | S | 12/2000 | Lum | D8/99 |
| 6,154,965 | A | 12/2000 | Sakai | 30/161 |
| 6,158,127 | A | 12/2000 | Taylor | 30/158 |
| D438,085 | S | 2/2001 | Onion | D8/99 |
| 6,256,888 | B1 | 7/2001 | Shuen | 30/161 |
| 6,276,063 | B1 | 8/2001 | Chen | 30/161 |
| 6,289,592 | B1 | 9/2001 | Emerson | 30/161 |
| 6,308,420 | B1 | 10/2001 | Moser | 30/161 |
| 6,338,431 | B1 | 1/2002 | Onion | 230/161 |
| 6,378,214 | B1 | 4/2002 | Onion | 30/161 |

| | | | | |
|---|---|---|---|---|
| 6,397,476 | B1 | 6/2002 | Onion | 30/160 |
| 6,397,477 | B1 | 6/2002 | Collins | 30/161 |
| 6,427,334 | B2 | 8/2002 | Onion | 30/161 |
| 6,427,335 | B1 | 8/2002 | Ralph | 30/161 |
| 6,430,816 | B2 | 8/2002 | Neveux | 30/161 |
| 6,434,831 | B2 | 8/2002 | Chen | 30/161 |
| 6,438,848 | B1 | 8/2002 | McHenry et al. | 30/161 |
| D462,581 | S | 9/2002 | Parlowski | D7/649 |
| D462,582 | S | 9/2002 | Parlowski | D7/649 |
| 6,442,843 | B1 | 9/2002 | Jue et al. | 30/151 |
| 6,490,797 | B1 | 12/2002 | Lake et al. | 30/161 |
| 6,523,265 | B2 * | 2/2003 | Eickhorn | 30/161 |
| 6,553,671 | B2 | 4/2003 | Blanchard | 30/161 |
| 6,574,869 | B1 | 6/2003 | McHenry et al. | 30/161 |
| 6,591,504 | B2 | 7/2003 | Onion | 30/160 |
| 6,651,344 | B2 | 11/2003 | Cheng | 30/159 |
| 6,732,436 | B2 | 5/2004 | Moizis | 30/155 |
| D498,985 | S | 11/2004 | Kerr et al. | D7/649 |
| 2002/0000042 | A1 | 1/2002 | Glesser et al. | 30/160 |
| 2002/0157260 | A1 | 10/2002 | Cheng | 30/161 |
| 2003/0070299 | A1 | 4/2003 | Frazer | 30/161 |
| 2003/0089750 | A1 | 5/2003 | Martinez | 224/232 |
| 2004/0020058 | A1 | 2/2004 | Vallotton | 30/160 |

FOREIGN PATENT DOCUMENTS

| | | |
|---|---|---|
| DE | 1 104 386 | 4/1961 |
| EP | 0 230 000 | 7/1987 |
| FR | 493 741 | 8/1919 |
| FR | 1 069 862 | 7/1954 |
| FR | 1 171 740 | 1/1959 |
| FR | 1 248 117 | 10/1960 |
| FR | 2 705 606 | 12/1994 |
| JP | 3-227601 | 10/1991 |
| JP | 4-030979 | 2/1992 |
| JP | 5-185381 | 7/1993 |

* cited by examiner

ADJUSTABLE BLADE-ASSISTING MECHANISM FOR A FOLDING KNIFE

CROSS-REFERENCE TO RELATED APPLICATIONS

This application claims priority under 35 U.S.C. § 119(e) to U.S. Provisional Patent Application Ser. No. 60/510,639 entitled "Adjustable Opening and Closing Assisting Mechanism for a Folding Knife," filed Oct. 10, 2003, the entire disclosure of which is herein incorporated by reference for all purposes.

TECHNICAL FIELD

The present disclosure relates generally to a folding knife, and particularly to a folding knife with an adjustable blade-assisting mechanism that urges the blade towards the open position and/or closed position.

BACKGROUND

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle and a closed position in which the blade is at least partially received within the handle. Many folding knives also include a blade-assisting mechanism that urges the blade towards the open position and/or closed position.

Examples of folding knives, including folding knives with blade-assisting mechanisms, may be found in U.S. Pat. Nos. 551,052; 552,928; 557,760; 600,442; 1,315,503; 1,319,532; 1,412,373; 1,440,793; 1,603,914; 1,701,027; 1,743,022; 1,864,011; 2,736,959; 5,293,690; 5,815,927; 5,822,866; 5,802,722; 5,819,414; 6,145,202; 6,308,420; 6,338,431; 6,378,214; 6,397,477; 6,651,344; and 6,732,436; and U.S. patent application Nos. 2003/0070299; 2004/0020058; and 2004/0158991, the entire disclosures of which are herein incorporated by reference for all purposes.

SUMMARY

One embodiment provides a folding knife. The folding knife includes a handle; a blade connected to the handle in a manner allowing movement of the blade between a closed position in which the blade extends along the handle and an open position in which the blade extends away from the handle; and a blade-assisting mechanism configured to apply a manually adjustable force to urge the blade towards the open position over at least a portion of the blade travel between the closed position and the open position.

DETAILED DESCRIPTION

Figure 1:
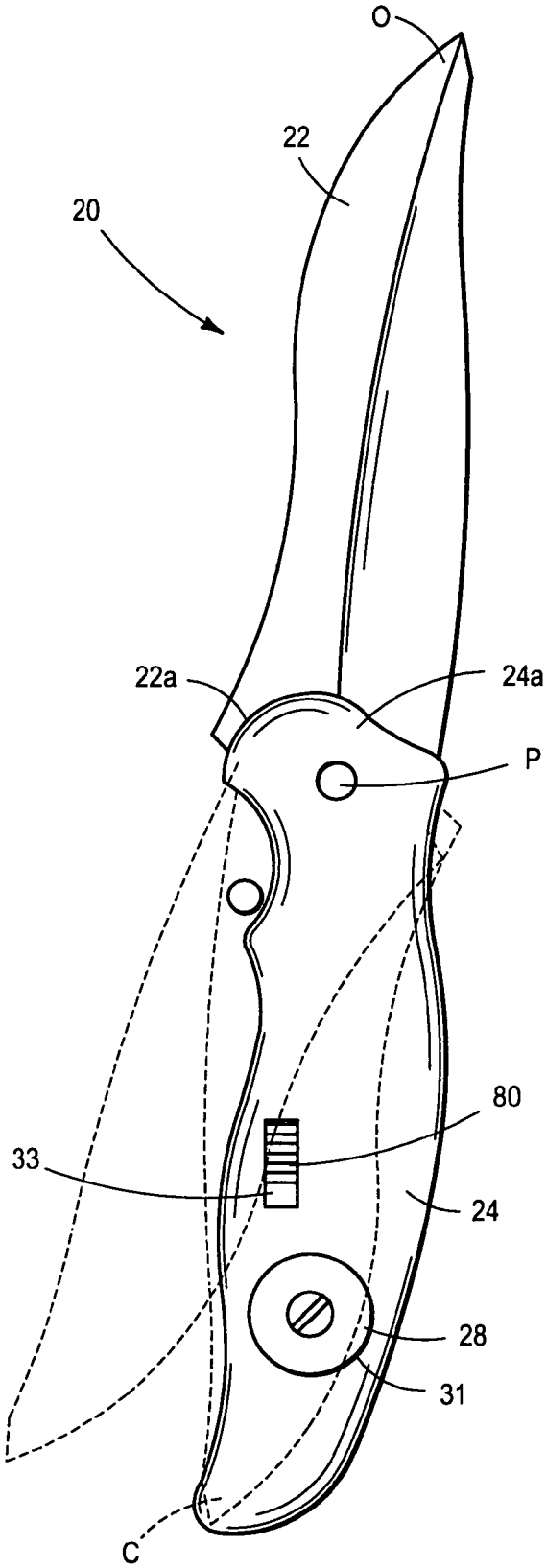
FIG. 1 is a side view of a folding knife incorporating an example of an adjustable blade-assisting mechanism and an example of a safety assembly.
Figure 2:
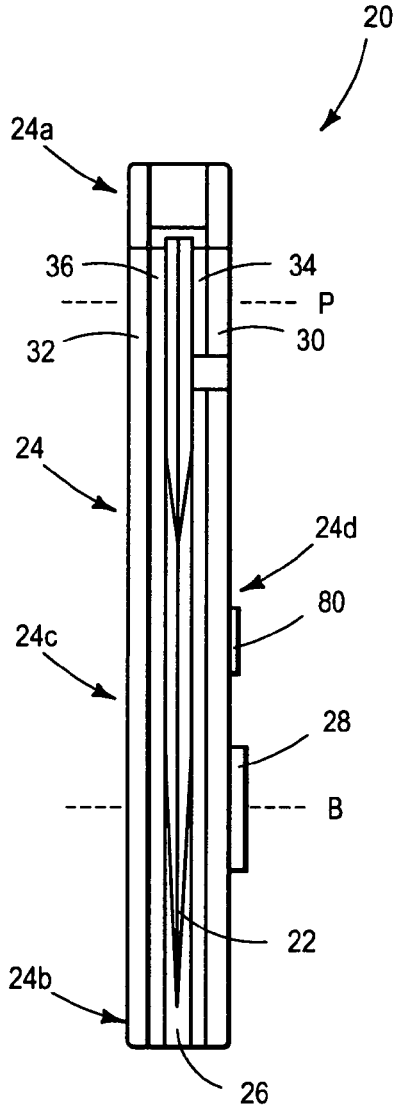
FIG. 2 is a front plan view of the folding knife of FIG. 1.

FIGS. 1-2 depict an embodiment of a folding knife 20 having a blade 22, a handle 24 defining a blade-receiving channel 26, and a blade-assisting mechanism 28. Blade 22 includes a tang 22*a* pivotally connected to an end 24*a* of handle 24. The blade pivots with respect to the handle about a pivot axis P between an open position O and a closed position C. In the open position, the blade extends away from the handle, where it is deployed and ready for use. From the open position, the blade may be folded towards the handle, pivoting about pivot axis P, into the closed position, in which the blade may be at least partially received for storage within blade-receiving channel 26. In the closed position, blade 22 extends along handle 24.

Handle 24 may include a pivot-end portion 24*a*, an opposing-end portion 24*b*, and first and second handle sides 24*c* and 24*d*. Tang 22*a* of blade 22 may be pivotally connected to handle 24 at pivot-end portion 24*a*. Handle sides 24*c* and 24*d* also may include respective handle side panels, such as opposite handle side panels 30 and 32. Handle side panels 30 and 32 may be any suitable shape or structure configured to facilitate gripping or handling of knife 20, including use of blade-assisting mechanism 28.

Additionally, handle 24 may include one or more handle liners, such as liners 34 and 36, which may be located between blade 22 and one or more of handle side panels 30 and 32. Handle side panels 30 and 32 may be any suitable shape or structure and may be configured to provide access to various components internal to handle 24. For example, one of handle side panels 30 and 32 may include slots 31 and 33 to provide access to an adjustment knob of a blade assisting mechanism and to a gripping portion of a safety assembly, as further discussed below.

Liners 34 and 36 may be any suitable shape or structure and may or may not conform to the shape of handle side panels 30 and 32. The liners also may be configured to accommodate and/or support various components internal to handle 24. For example, one of liners 34 and 36 may include arcuate groove 37 to allow blade-assisting mechanism to operatively connect with blade 22, as further discussed below. Although the knife discussed and shown in FIGS. 1-2 includes two handle side panels and two liners, any combination of handle side panels and liners may be used.

Blade-assisting mechanism 28 may include any structure configured to apply a biasing force F to urge blade 22 towards the open position and/or closed position and to allow a user to adjust the biasing force. For example, as shown in FIGS. 3-6, blade-assisting mechanism 28 may include a bias element 38, a connector element 40, and an adjustment element 42.

Figure 3:
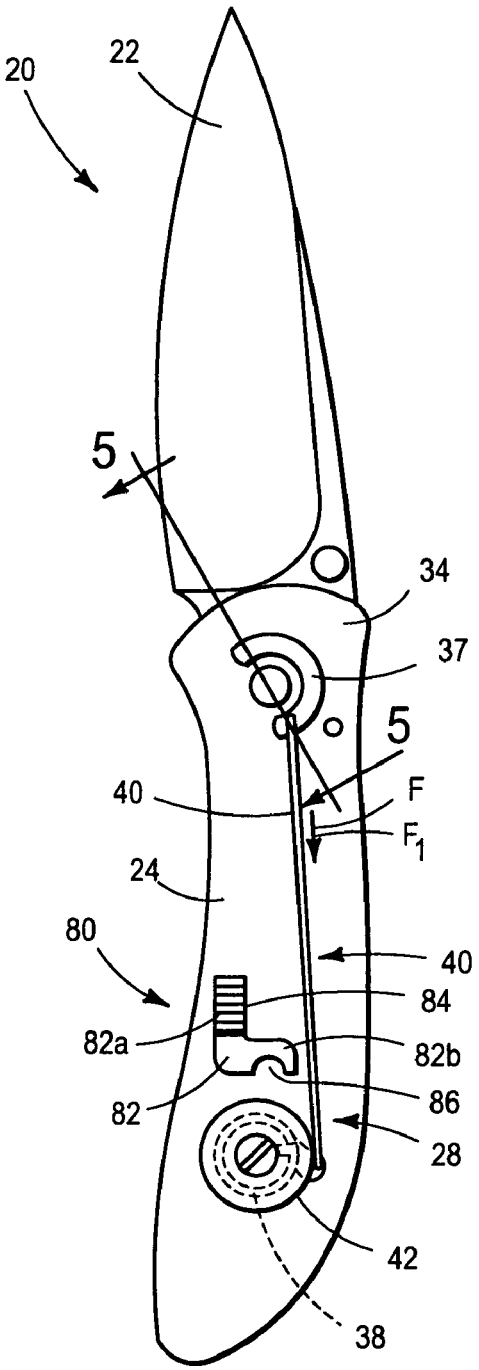
FIG. 3 is a side view of the folding knife of FIG. 1, shown without a handle side panel to illustrate the adjustable blade-assisting mechanism with the blade in the open position and the safety assembly is in the unlocked position.
Figure 4:
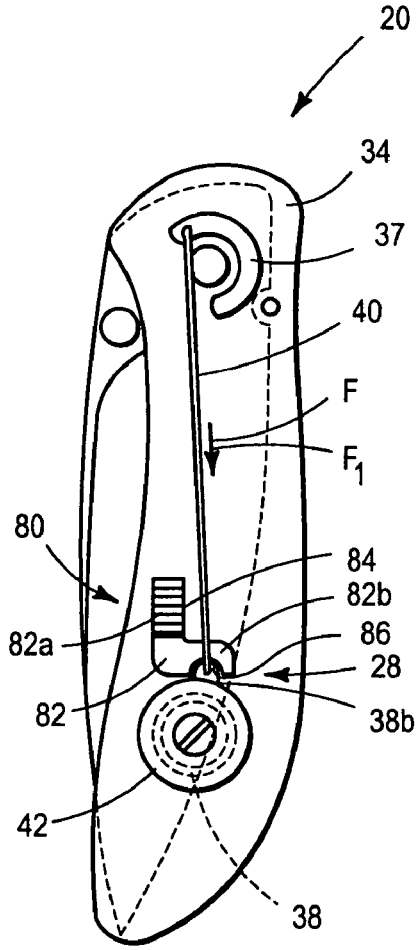
FIG. 4 is a side view of the folding knife of FIG. 1, shown without a handle side panel to illustrate the adjustable blade-assisting mechanism with the blade in the closed position and the safety assembly is in the locked position.
Figure 6:
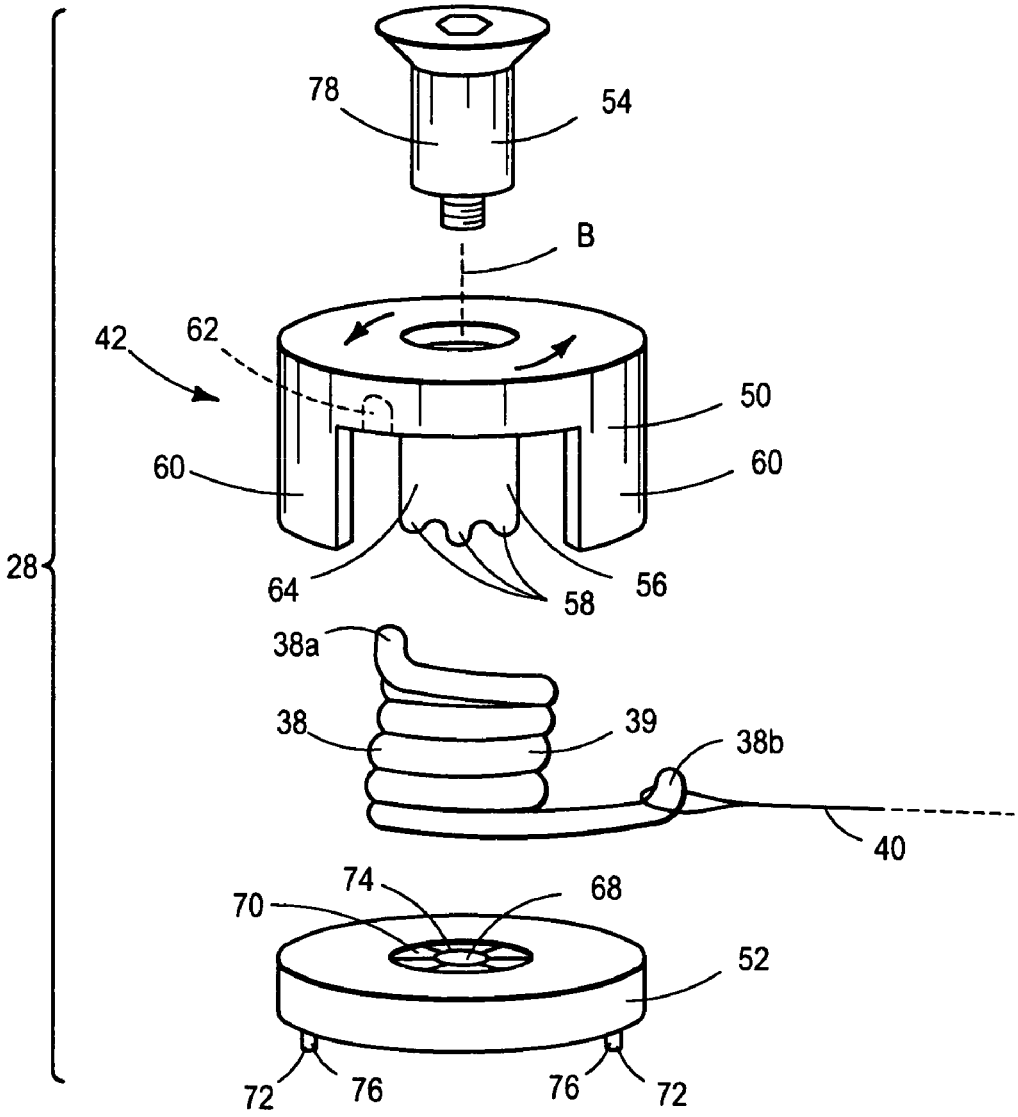
FIG. 6 is an exploded view of the adjustable blade-assisting mechanism of the folding knife of FIG. 1.

Bias element 38 may include any structure configured to apply biasing force F to urge blade 22 towards the open position and/or closed position. For example, bias element 38 may be in the form of a coiled spring 39, as shown in FIG. 6. The bias element may include a first end 38*a* and a second end 38*b*. Additionally, bias element 38 may be configured to provide biasing force F in any suitable direction. For example, bias element 38 in FIGS. 3-4 provides a biasing force $F_1$ in a "pulling direction" from pivot end 24*a* of handle 24 toward the opposing end 24*b*. Alternatively, bias element 38 may be configured to provide a biasing force $F_2$ in a "pushing direction" from opposing end 24*b* toward pivot end 24*a*, as further discussed below and in FIGS. 8-10. Moreover, other suitable directions may be used for biasing force F.

Although bias element 38 is depicted as a coiled spring, it may be of any other suitable type of bias element configured to apply biasing force F to urge blade 22 towards the open position and/or closed position, such as wire springs, leaf springs, piano wires, or other resilient material or structure.

Figure 7:
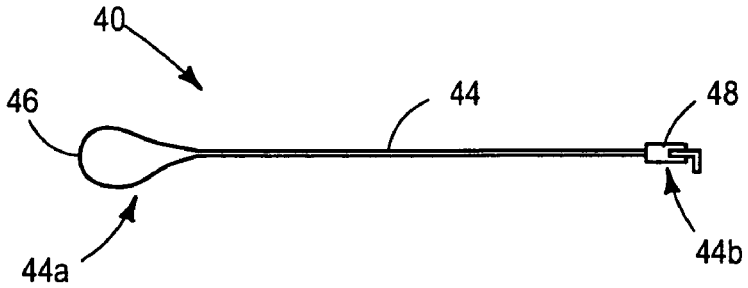
FIG. 7 is side view of a connector element that is part of the adjustable blade-assisting mechanism of the folding knife of FIG. 1.

Connector element 40 may include any structure operatively connecting bias element 38 and blade 22. For example and particularly when bias element 38 provides biasing force $F_1$, the connector element may include a laterally flexible cable or cord 44, as shown in FIG. 7. The flexible cable may be made of any suitable resilient material. Optionally and particularly when bias element 38 provides biasing force $F_2$, connector element 40 may include a push rod made of any suitable rigid material, as further discussed below. Optionally, biasing force F may be provided only by a resilient cable or other structure, without the use of separate bias element 38.

Figure 5:
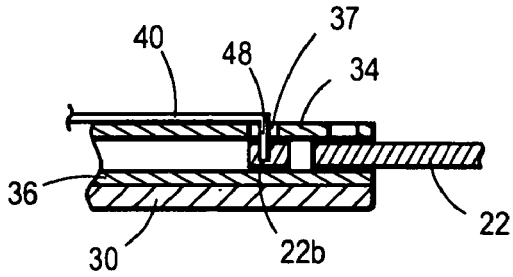
FIG. 5 is a cross-sectional view of the adjustable blade-assisting mechanism taken along lines 5-5 shown in FIG. 3 illustrating a connection to the blade.

Flexible cable 44 may include a first end portion 44*a* and a second end portion 44*b*. First end portion 44*a* may have any suitable shape or structure configured to operatively connect that portion to second end 38*b* of bias element 38, such as eyelet 46. Second end portion 44*b* may have any suitable shape or structure configured to operatively connect that portion to blade 22, such as hook 48. Hook 48 may engage a hole 22*b* in tang 22*a* of blade 22 via arcuate groove 37, as shown in FIG. 5.

Although the first and second end portions of flexible cable 44 are shown to include eyelet 46 and hook 48, respectively, any suitable shape or structure may be used, such as latches or posts, or mechanical, magnetic, or electronic devices, configured to operatively connect flexible cable 44 to bias element 38 and/or blade 22. Moreover, although the first and second end portions of flexible cable 44 include different shapes or structures, the same shape or structure may be used for both end portions.

"Operatively connecting," "operatively connect," "operatively connected," or "operative connection," as used herein, refers to a connector element being directly and/or indirectly connected to a bias element and/or to a blade in a manner that allows that bias element to apply biasing force F to urge the blade towards the open position and/or closed position. For example, connector element 40 may be directly connected to bias element 38 but indirectly connected to blade 22, such as by contacting a post or any other structure on the blade. Additionally, the operative connection made by the connector element may be throughout the pivoting of the blade or may be during only part of the pivoting of that blade. For example, the connector element may contact the blade or a post on the blade only between the blade's closed position and an intermediate blade position.

Blade-assisting mechanism 28 also may include adjustment element 42, which may include any structure configured to allow a user to adjust the biasing force from bias element 38 from outside handle 24. For example, as shown in FIG. 6, adjustment element 42 may include an adjustment knob 50, a platform 52, and a retainer 54.

Adjustment knob 50 may be pivotally mounted to pivot around a bias axis B. The bias axis may or may not be parallel to pivot axis P. The adjustment knob also may include a support 56, mating ridges 58, spacers 60, and holder 62. Support 56 may be any suitable shape or structure configured to support bias element 38. For example, support 56 may be a hollow cylindrical portion 64 configured to support coiled spring 39 and to receive retainer 54. Mating ridges 58 may be any suitable shape or structure configured to engage the mating ridges of platform 52, as further discussed below, and prevent the user from rotating adjustment knob 50. Spacers 60 may be any suitable shape or structure configured to house bias element 38. Holder 62 may be any suitable shape or structure configured to engage first end 38*a* of bias element 38 and allow adjustment knob 50 to adjust biasing force F from the bias element.

Platform 52 may be any suitable shape or structure configured to be mounted on one of liners 34 and 36. For example, platform 52 may be in the shape of a disk. The platform may include a receptacle 68, mating sockets 70, and stabilizers 72. Receptacle 68 may be any suitable shape or structure configured to receive retainer 54, as further discussed below. For example, receptacle 68 may be a threaded hole 74. Mating sockets 70 may be any suitable shape or structure configured to engage mating ridges 58 of adjustment knob 50 and prevent the user from rotating that adjustment knob. Stabilizers 72 may be any suitable shape or structure configured to stabilize platform 52 and prevent that platform from pivoting with adjustment knob 50. For example, as shown in FIG. 6, stabilizers 72 may be in the form of anti-spin pegs 76.

Although platform 52 is shown to be separate from liners 34 and 36 and handle side panels 30 and 32, the platform or at least some of its components may be made integral to the liner and/or handle side panel. For example, liner 34 may be configured to include receptacle 68 and mating sockets 70.

Adjustment element 42 also may include retainer 54, which may be any suitable shape or structure configured to secure adjustment knob 50 to one of liners 34 and 36. For example, retainer 54 may be in the form of a screw or bolt 78, as shown in FIG. 6. Retainer 54 also may selectively prevent pivoting of adjustment knob 50. For example, a user may tighten retainer 54 to mesh mating ridges 58 and mating sockets 70 thereby preventing pivoting of adjustment knob 50. The user can then loosen retainer 54 to pivot the adjustment knob. Although retainer 54 is shown to be in the form of a bolt, any suitable retainer may be used configured to secure adjustment knob 50 to one of liners 34 and 36, such as latching elements, pins, or posts, or mechanical, magnetic, or electronic devices, or the like.

Although blade-assisting mechanism 28 is shown to include the elements in FIG. 6, any suitable structure may be used and configured to apply biasing force F to blade 22 to urge that blade towards the open position and/or closed position. Additionally, although blade-assisting mechanism 28 is shown to be mostly located and/or mounted on liner 34 between handle side panel 30 and blade 22, the blade-assisting mechanism may be located on either of the handle side panels and/or either of the liners.

Folding knife 20 also may include a safety assembly 80, which may include any suitable structure configured to prevent blade-assisting mechanism 28 from applying biasing force F to blade 22. For example, as shown in FIGS. 1-4, safety assembly 80 may include a safety element 82 slidably mounted between handle side panel 30 and liner 34. The safety assembly may slide between a safety position in which the safety element engages part of blade-assisting mechanism 28 in a manner preventing that mechanism from applying the biasing force to blade 22, and a release position in which blade-assisting mechanism 28 is free to apply the biasing force to blade 22.

Safety element 82 may include a gripping portion 82*a* and a capturing portion 82*b*. Gripping portion 82*a* may be any suitable shape or structure configured to allow safety element 82 to be manipulated from outside of handle 24. For example, gripping portion 82*a* may include gripping ridges 84 or other suitable surface texture or structure. Capturing portion 82*b* may be any suitable shape or structure configured to engage part of blade-assisting mechanism 28 and prevent that mechanism from applying the biasing force to blade 22. For example, capturing portion 82*b* may be shaped to as a notch 86 sized to receive second end 38*b* of bias element 38, thereby preventing adjustment knob 50 from pivoting and blade-assisting mechanism 28 from applying biasing force F to blade 22. In some embodiments, the safety assembly also may prevent pivoting of blade 22.

Although safety element 82 is shown to engage second end 38*b* of bias element 38, any suitable part of blade-assisting mechanism 28 may be engaged by capturing portion 82*b* of the safety element to prevent that mechanism from applying biasing force F to the blade.

Figure 8:
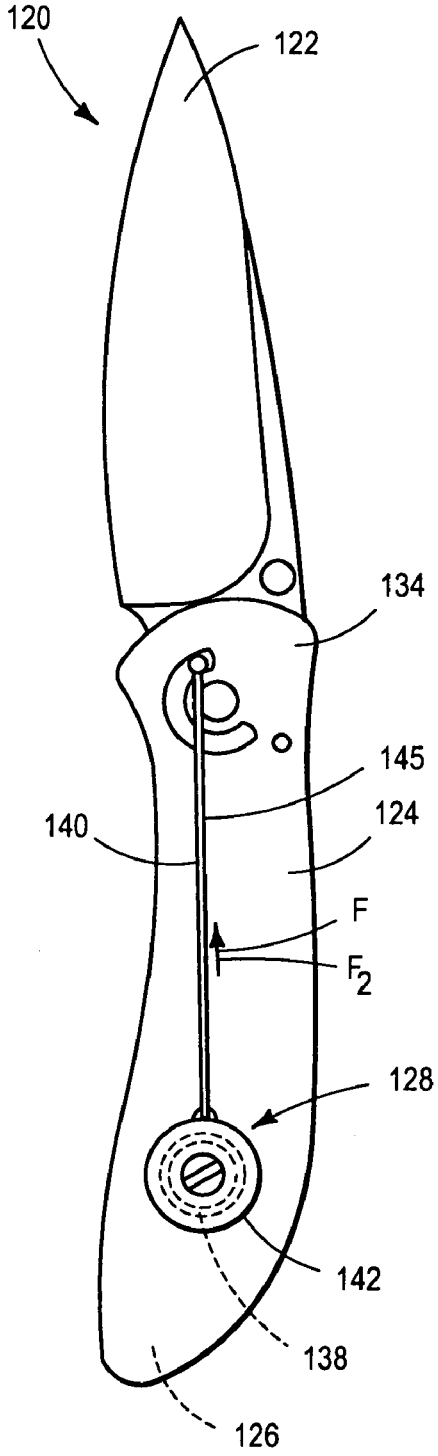
FIG. 8 is a side view of another example of a folding knife with an adjustable blade-assisting mechanism, the knife shown without a handle side panel and with the blade in the open position.
Figure 9:
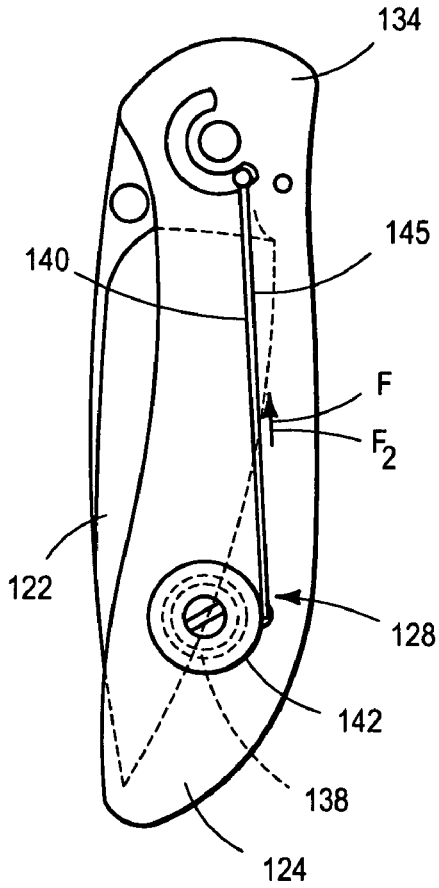
FIG. 9 is a side view of the folding knife of FIG. 8, shown without a handle side panel to illustrate the adjustable blade-assisting mechanism with the blade in the closed position.
Figure 10:
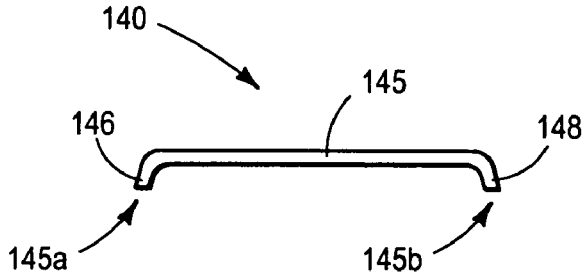
FIG. 10 is side view of a connector element that is part of the adjustable blade-assisting mechanism of the folding knife of FIG. 8.

An alternative embodiment of folding knife 20 is shown in FIGS. 8-10 and generally indicated at 120. Unless otherwise specified, folding knife 120 may selectively include any of the elements, subelements, and variations as the other folding knives illustrated, described, or incorporated herein. Similar to the previously discussed embodiment, folding knife 120 includes a blade 122, a handle 124 including a blade-receiving channel 126, and a blade-assisting mechanism 128. Handle 124 includes at least one liner 134 on which blade-assisting mechanism 128 may be mounted, and at least one handle side panel (not shown in FIGS. 8-10) that may cover most of blade-assisting mechanism 128.

Blade-assisting mechanism 128 may include a bias element 138, a connector element 140, and an adjustment element 142. Bias element 138 may include any suitable structure configured to provide biasing force $F_2$ in a "pushing direction." For example, bias element 138 may be in the form of a coiled spring or other resilient structures or material described above configured to provide biasing force $F_2$.

Connector element 140 may include any suitable structure configured to operatively connect bias element 138 and blade 122. For example, connector element 140 may be in the form of a push rod 145. The push rod may be made of any suitable rigid material. Push rod 145 may include a first end portion 145*a* and a second end portion 145*b*, as shown in FIG. 10. First end portion 145*a* may have any suitable shape or structure configured to operatively connect to bias element 138, such as hook 146. Second end portion 145*b* may have any suitable shape or structure configured to operatively connect blade 122, such as hook 148 that engages a hole in (not shown) blade 122.

Although the first and second end portions of push rod 145 are shown to include hooks 146 and 148, any suitable shape or structure may be used, such as latches or posts, or mechanical, magnetic, or electronic devices, configured to operatively connect push rod 145 to bias element 138 and/or blade 122. Moreover, although the first and second end portions of push rod 145 include similar shapes or structures, different shapes or structures may be used for the end portions. Furthermore, although blade-assisting mechanism 128 is configured to apply biasing force $F_2$ in the pushing direction, the blade-assisting mechanism may be configured to apply biasing force $F_1$ in the pulling direction, or any other biasing forces in any suitable directions.

Figure 11:
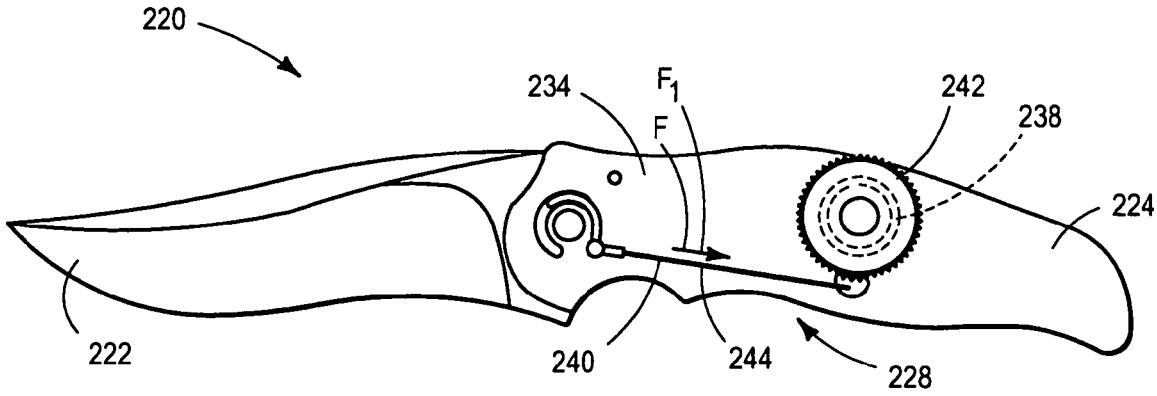
FIG. 11 is a side view of another example of a folding knife with an adjustable blade-assisting mechanism, shown without a handle side panel with the blade in the open position.
Figure 12:
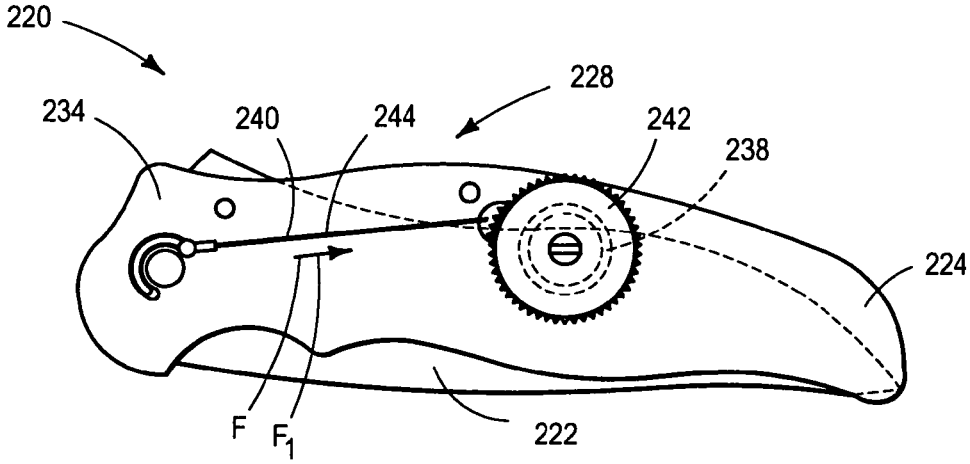
FIG. 12 is a side view of the folding knife of FIG. 11, shown without a handle side panel to illustrate the adjustable blade-assisting mechanism with the blade in the closed position.
Figure 13:
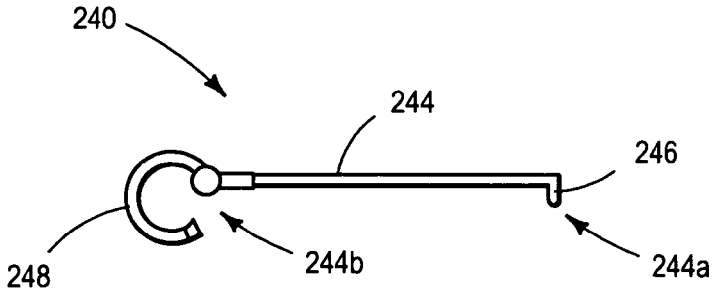
FIG. 13 is a side view of a connector element that is part of the adjustable blade-assisting mechanism of the folding knife of FIG. 11.

Another alternative embodiment of folding knife 20 is shown in FIGS. 11-13 and generally indicated at 220. Unless otherwise specified, folding knife 220 may selectively include any of the elements, subelements, and variations as the other folding knives illustrated, described, or incorporated herein. Similar to the previously discussed embodiments, folding knife 220 includes a blade 222, a handle 224 including a blade-receiving channel 226, and a blade-assisting mechanism 228. Handle 224 includes at least one liner 234 on which blade-assisting mechanism 228 may be mounted, and at least one handle side panel (not shown in FIGS. 11-13) that may cover most of blade-assisting mechanism 228.

Blade-assisting mechanism 228 may include a bias element 238, a connector element 240, and an adjustment element 242. Bias element 238 may include any suitable structure configured to provide biasing force $F_1$ in a "pulling direction."For example, bias element 238 may be in the form of a coiled spring or other resilient structure or material, such as the structures described above that are configured to provide biasing force $F_1$.

Blade-assisting mechanism 228 may include a bias element 238, a connector element 240, and an adjustment element 242. Bias element 238 may include any suitable structure configured to provide biasing force $F_1$ in a "pulling direction." For example, bias element 238 may be in the form of a coiled spring or other resilient structure or material, such as the structures described above that are configured to provide biasing force $F_2$.

Connector element 240 may include any suitable structure configured to operatively connect bias element 238 and blade 222. For example, connector element 240 may be in the form of a flexible cord 244. The flexible cord may be made of any suitable resilient material. Flexible cord 244 may include a first end portion 244*a* and a second end portion 244*b*, as shown in FIG. 13. First end portion 244*a* may have any suitable shape or structure configured to operatively connect to bias element 238, such as hook 246. Second end portion 244*b* may have any suitable shape or structure configured to connect to a bracket 248. Bracket 248 includes any structure configured to operatively connect second end portion 244*b* to blade 222. Although bracket 248 is shown in FIGS. 11-13 to be C-shaped, it may S-shaped, horseshoe-shaped, or any suitable shaped configured to operatively connect second end portion 244*b* to blade 222.

Although the first and second end portions of flexible cord 244 are shown to include hook 246 and bracket 248, any suitable shape or structure may be used, such as latches or posts, or mechanical, magnetic, or electronic devices, configured to operatively connect flexible cord 244 to bias element 238 and/or blade 222. Moreover, although the first and second end portions of flexible cable 244 include different shapes or structures, similar shapes or structures may be used for the end portions. Furthermore, although blade-assisting mechanism 228 is configured to apply biasing force $F_1$ in the pulling direction, the blade-assisting mechanism may be configured to apply biasing force $F_2$ in the pushing direction, or any other biasing forces in any suitable directions.

Although the adjustable blade-assisting mechanisms are shown to be used in folding knives with pivoting blades, the adjustable blade-assisting mechanisms disclosed may be used for folding knives with other types of moving blades that are configured to move between the open position and the closed position.

Although particular examples of blade-assisting mechanisms have been disclosed, any suitable structure may be used configured to apply a biasing force F to a blade and urge the blade towards an open position and/or closed position. For example, blade-assisting mechanism may include a bias element and an adjustment element. In that mechanism, the bias element may be positioned around a pivot pin of a blade and operatively connected to the blade and to the adjustment element. The adjustment element may be located adjacent the pivot pin of the blade and allows adjustment of the biasing force applied by the bias element.

Another example of a blade-assisting mechanism may include a bias element, at least one connector element, and an adjustment element. In that mechanism, bias element may provide a biasing force perpendicular to a pivot axis of a blade. The at least one connector element may include a lever with first and second ends that pivot around an axis parallel to the pivot axis. The first end of the lever may be operatively connected to the bias element and the second end of the lever may be operatively connected to the blade, such as the second end acting on a pin or other structure on the blade during at least a part of the blade movement between the open position and the closed position. The bias element may then apply a biasing force in a first direction to the first end of the lever, which translates to a biasing force in a second direction to the second end of the lever and to the blade. The adjustment element allows adjustment of the biasing force applied by the bias element.

Although the folding knives and features of folding knives has been shown and described with reference to the foregoing operational principles and preferred embodiments, those skilled in the art will find apparent that various changes in form and detail may be made without departing from the spirit and scope of the claims. The present disclosure is intended to embrace all such alternatives, modifications, and variances that fall within the scope of the appended claims.

I Claim:

1. A folding knife, comprising:

a handle;

a blade connected to the handle in a manner allowing movement of the blade between a closed position in which the blade extends along the handle and an open position in which the blade extends away from the handle;

a blade-assisting mechanism including a bias element and an adjustment element, said bias element configured to apply a biasing force to urge the blade towards the open position over at least a portion of the blade travel between the closed position and the open position; and said adjustment element configured to allow a user to selectively adjust the biasing force of the bias element to urge the blade towards the open position, the adjustment element having a portion exposed at a surface of the handle.

2. The folding knife of claim 1, wherein the bias element includes a coiled spring.

3. The folding knife of claim 1, wherein the blade-assisting mechanism includes at least one connector element operatively connecting the bias element and the blade.

4. The folding knife of claim 3, wherein the at least one connector element includes a flexible cable.

5. The folding knife of claim 4, wherein the at least one connector element includes a bracket connected to an end of the flexible cable.

6. The folding knife of claim 3, wherein the at least one connector element includes a push rod.

7. The folding knife of claim 6, wherein the at least one connector element includes a bracket connected to an end of the push rod.

8. The folding knife of claim 1, wherein the adjustment element is manipulable from outside the handle.

9. The folding knife of claim 8, wherein the adjustment element is pivotally mounted on the handle to pivot around a bias axis.

10. The folding knife of claim 9, wherein the bias axis is parallel to a pivot axis of the blade.

11. The folding knife of claim 8, wherein the bias element is a coiled spring including first and second ends, the first end is connected to the adjustment element, and the adjustment element is configured to pivot the first end around a bias axis.

12. The folding knife of claim 11, wherein the blade pivots about a pivot axis, and the bias axis is parallel to the pivot axis.

13. The folding knife of claim 1, further comprising a safety element movable relative to the handle between a safety position in which the safety element engages part of the blade-assisting mechanism in a manner preventing the blade-assisting mechanism from applying the force to the blade, and a release position in which the blade-assisting mechanism applies the force to the blade.

14. The folding knife of claim 1, wherein the bias element is configured to apply the force to urge the blade towards at least one of the open position and the closed position.

15. The folding knife of claim 1 wherein the blade-assisting mechanism is configured to apply a force to urge the blade towards the open position over a portion of the blade travel, and also the closed position over a portion of the blade travel.

16. A folding knife, comprising:

a handle;

a blade pivotably connected to the handle in a manner allowing pivoting of the blade from a closed position in which the blade extends along the handle, to an open position in which the blade extends away from the handle;

a bias element configured to apply a biasing force between the handle and the blade to urge the blade towards the open position; and user adjustable element operatively connected to the bias element and configured to be manipulable to allow a user to selectively vary the biasing force of the bias element.

17. The folding knife of claim 16, wherein the bias element includes a coiled spring having an end and a flexible cable operatively connecting the blade to the end of the coiled spring.

18. The folding knife of claim 16, wherein the bias element includes a coiled spring having first and second ends and a push rod operatively connecting the blade to the first end of the spring.

19. The folding knife of claim 18, wherein the handle pivots about a pivot axis, and the second end of the spring is connected to the adjustable element and the adjustable element is pivotally mounted on the handle to pivot around a bias axis parallel to the pivot axis.

20. The folding knife of claim 16, further comprising a safety element movable relative to the handle between a safety position in which the safety element engages part of the bias element in a manner preventing the bias element from applying the force to the blade, and a release position in which the bias element applies the force to the blade.

21. The folding knife of claim 16, wherein the bias element is configured to apply the biasing force to urge the blade towards at least one of the open position and the closed position.

22. The folding knife of claim 21, wherein the bias element is configured to apply the biasing force to urge the blade towards both the open position and the closed position.

23. The folding knife of claim 16, wherein the adjustable element is configured to be manipulable from outside the handle to allow a user to selectively vary the biasing force of the bias element.

24. A folding knife, comprising:

a handle;

a blade pivotably connected to the handle in a manner allowing pivoting of the blade around a pivot axis from a closed position in which the blade extends along the handle, to an open position in which the blade extends away from the handle; and a blade-assisting mechanism including:

a bias element disposed within the handle and operatively connecting the handle to the blade, wherein the bias element is configured to apply a biasing force to urge the blade towards at least one of the open position and the closed position;

at least one connector element configured to operatively connect the bias element to the blade; and an adjustment element operatively connected to the bias element, pivotally mounted on the handle to pivot around a bias axis parallel to the pivot axis, and configured to be manipulable outside the handle to allow a user to selectively adjust the biasing force.

25. The folding knife of claim 24, further comprising a safety element movable relative to the handle between a safety position in which the safety element engages part of the blade-assisting mechanism in a manner preventing the blade-assisting mechanism from applying the force to the blade, and a release position in which the blade-assisting mechanism applies the force to the blade.

* * * * *

UNITED STATES PATENT AND TRADEMARK OFFICE

CERTIFICATE OF CORRECTION

PATENT NO. : 7,296,355 B2
APPLICATION NO. : 10/964577
DATED : November 20, 2007
INVENTOR(S) : Kenneth J. Onion It is certified that error appears in the above-identified patent and that said Letters Patent is hereby corrected as shown below:

On the title page item (73)
Assignee information "Kai U.S.A., Ltd.," should read as -- Kai U.S.A., Ltd., DBA Kershaw Knives --

Signed and Sealed this

Twenty-first Day of October, 2008

JON W. DUDAS
*Director of the United States Patent and Trademark Office*